US005152621A

United States Patent [19]

Tsuji

[11] Patent Number: 5,152,621

[45] Date of Patent: Oct. 6, 1992

[54] FILM RIBBON CASSETTE WITH MECHANISM FOR PREVENTING REVERSE ROTATION

[75] Inventor: Takao Tsuji, Tokyo, Japan

[73] Assignee: NEC Corporation, Tokyo, Japan

[21] Appl. No.: 652,723

[22] Filed: Feb. 8, 1991

[30] Foreign Application Priority Data

Feb. 8, 1990 [JP] Japan ..... 2-30154

[51] Int. Cl.[5] ..... B41J 33/14

[52] U.S. Cl. ..... 400/208; 400/236; 242/197; 242/206

[58] Field of Search ..... 400/208, 208.1, 207, 400/196.1, 194-196, 236; 242/197, 198, 199, 200, 206-210

[56] References Cited

U.S. PATENT DOCUMENTS

| | | | |
|---|---|---|---|
| 3,349,887 | 10/1967 | Goff, Jr. | 400/208 |
| 3,804,227 | 4/1974 | Cappotto et al. | 400/208 |
| 4,034,935 | 7/1977 | Plaza et al. | 400/208 |
| 4,337,001 | 6/1982 | Cappotto | 400/208 |
| 4,339,211 | 7/1982 | Alexander et al. | 400/208 |
| 4,347,008 | 8/1982 | Jagodzinski et al. | 400/208 |
| 4,400,103 | 8/1983 | Daughters | 400/208 |
| 4,448,556 | 5/1984 | Trezise et al. | 400/208 |
| 4,650,357 | 3/1987 | Sidvers et al. | 400/208 |
| 4,990,008 | 2/1991 | Hwang | 400/208 |
| 5,005,999 | 4/1991 | Raar et al. | 400/208 |

FOREIGN PATENT DOCUMENTS

| | | | |
|---|---|---|---|
| 0209185 | 11/1984 | Japan | 400/208 |
| 0244583 | 10/1986 | Japan | 400/208 |
| 2091644 | 8/1982 | United Kingdom | 400/208 |

OTHER PUBLICATIONS

"Ribbon Back Check Mechanism" IBM Technical Disclosure Bulletin, vol. 27, No. 12 May 1985 pp. 6855-6856.

"Ribbon Cartridge with Brake" IBM Technical Disclosure Bulletin, vol. 10, No. 4, Sep. 1967, pp. 484-485.

"Ribbon Feed for Biodirectional Printer" IBM Technical Disclosure Bulletin, vol. 23, No. 4, Sep. 1980, pp. 1517-1526.

*Primary Examiner*—Eugene H. Eickholt

*Attorney, Agent, or Firm*—Sughrue, Mion, Zinn, Macpeak & Seas

[57] ABSTRACT

A cassette comprises a driving roller provided with a device for preventing the reverse rotation, a driving pulley connected with the driving roller, a rubber belt for transmitting a motion of the driving pulley and a take-up spool on which a film ribbon is wound, and optionally a mechanism for maintaining tension occurred in the film ribbon constant. This arrangement ensures a unidirectional rotation of the driving roller and a correct tension of the ribbon at all times, whereby high quality in printing can be attained.

1 Claim, 4 Drawing Sheets

FILM RIBBON CASSETTE WITH MECHANISM FOR PREVENTING REVERSE ROTATION

BACKGROUND OF THE INVENTION

1. Field of the Invention

This invention relates to a film ribbon cassette of a serial printer.

2. Description of the Prior Art

In the prior film ribbon cassette of a serial printer, a film ribbon is moved in a constant speed by a driving roller and the film ribbon which has been put into printing is wound on a take-up spool by utilizing rotation of the driving roller, which is transmitted through a rubber belt to the take-up spool.

In the prior film ribbon cassette of a serial printer as mentioned above, the film ribbon is moved in a constant speed by the driving roller but the film ribbon which has been used for printing is wound by rotating a take-up spool through a driving pulley directly connected with the driving roller and the rubber belt. As a result, rotation speed of the take-up spool becomes slower as wound amount of the film ribbon becomes larger. Thus, if smooth sliding does not occur between the rubber belt and the driving pulley and take-up spool, difference in tension between a tight side and a slack side of the rubber belt becomes larger as the amount of the film ribbon wound on the winding pulley becomes larger. Therefore, when gears in a ribbon feed mechanism of the printer are cut off and as a result only the tension of the rubber belt is applied to the driving roller, rotation of the driving roller becomes opposite to the normal rotation due to the difference in tension of the rubber belt. Thus, if ribbon feed operation exceeding a length of the ribbon moved into the above opposite direction is not made when the following normal ribbon feed is performed, the ribbon put in front of a printing head becomes left as it is or not moved. This results in a defect that printing density gets thin and thus the quality in printing is deteriorated.

SUMMARY OF THE INVENTION

It is an object of the invention to provide an improved film ribbon cassette of a serial printer wherein a driving roller driven by traverse operation of a carriage of the serial printer is provided with mechanism for preventing the reverse rotation, whereby the thinner printing density is prevented and the high quality in printing can be attained.

The above object is accomplished by a film ribbon cassette of a serial printer which comprises a driving roller being driven by traverse operation of a carriage of a serial printer, a driving pulley directly connected to the end portion of said driving roller, a rubber belt for transmitting the rotating motion of said driving pulley and a take-up spool for winding the film ribbon which is driven by said rubber belt, said driving roller being provided with a device for preventing the reverse rotation.

The above object is also accomplished by a film ribbon cassette of a serial printer which comprises a driving roller being driven by traverse operation of a carriage of the serial printer, a driving pulley directly connected to the end portion of said driving roller, a rubber belt for transmitting the rotation motion of said driving pulley and a take-up spool for winding the film ribbon which is driven by said rubber belt, an outer casing of said driving roller being provided with a tooth portion for preventing reverse rotation on the inner periphery thereof and a spindle portion of said driving roller being provided with a ratchet wheel having a ratchet portion which is engaged with said tooth portion.

BRIEF DESCRIPTION OF THE DRAWINGS

By way of example of the many features and advantages of the invention, an illustrative embodiment in the film ribbon of the serial printer is described below and shown in the accompanying drawings, in which.

DETAILED DESCRIPTION OF THE PREFERRED EMBODIMENT

According to this invention, a film ribbon cassette of a serial printer has a device for preventing reverse rotation of a driving roller for traversing the film ribbon, said device is adapted so as to rotate the driving roller only in the unidirectional direction.

Namely, according to this invention, the film ribbon cassette of the serial printer comprises a driving roller being driven by traverse operation of a carriage of the serial printer, a driving pulley directly connected to the end portion of said driving roller, a rubber belt for transmitting the rotating motion of said driving pulley and a take-up spool for winding the film ribbon which is driven by said rubber belt, said driving roller being provided with a device for preventing the reverse rotation.

Next, this invention will be described with reference to the accompanying drawings.

Figure 1:
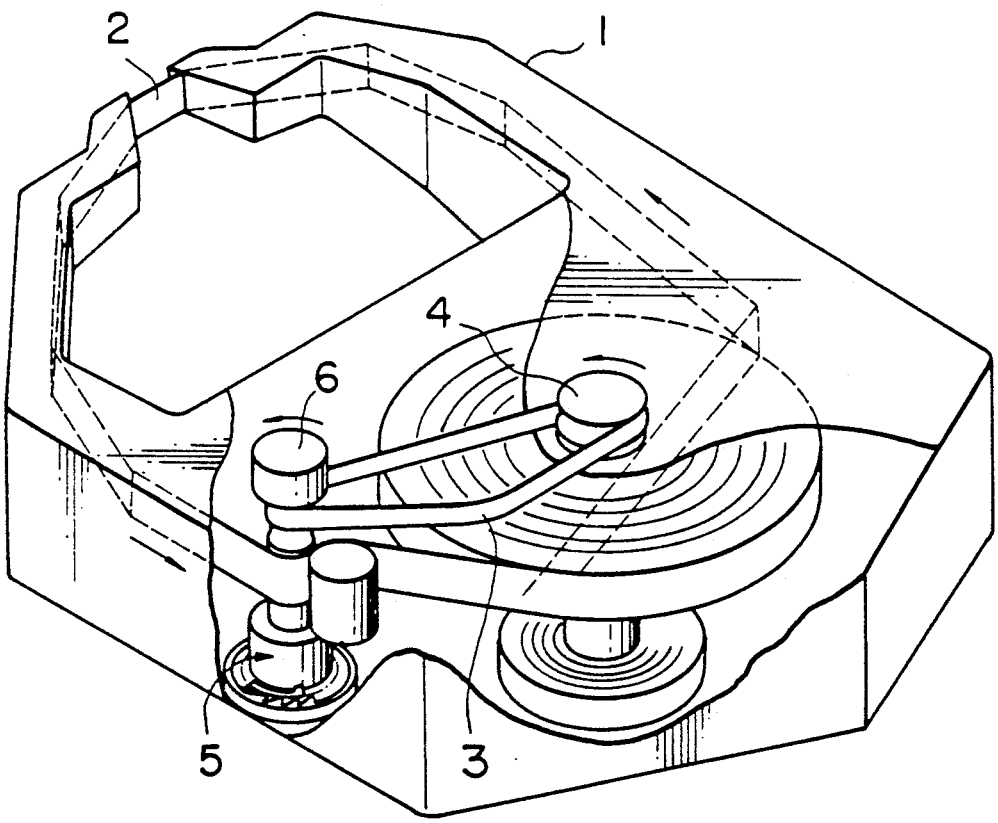
FIG. 1 is a cross-eyed view schematically showing the film ribbon cassette according to one embodiment of this invention.

FIG. 1 shows a cross-eyed view of the film ribbon cassette according to one embodiment of this invention.

According to the embodiment as shown in FIG. 1, the film ribbon cassette 1 comprises a film ribbon 2 on which ink is coated, a driving roller mechanism 5 for traversing the film ribbon 2 in constant speed, a driving pulley 6 directly connected with the driving roller, a winding pulley 4 which is rotated by driving pulley 6 and on which the film ribbon 2 is wound, and a rubber belt for transmitting the rotating power of the driving pulley to the take-up spool 4.

Thus constructed ink ribbon cassette 1 is fitted in the serial printer, the driving roller mechanism 5 is rotated by utilizing the traverse operation of the carriage of a printer body (not shown) and through a ribbon feed mechanism, and the film ribbon is traversed or fed in such a manner that a virgin portion of the film ribbon always lies in front of a printing head. The used portion of the film ribbon which was printed by the printing head is wound on the take-up spool 4 through the driving pulley 6 directly connected with the driving roller 5 and the rubber belt 3, and as a result, the outer diameter of the film ribbon wound on the winding pulley 4 becomes larger as the used portion of the film ribbon increases in quantity. Thus, if smooth sliding does not occur between the rubber belt 3 and the winding pulley 4, difference in tension between a tight side and a slack side of the rubber belt 3 becomes larger. When the traverse operation of the film ribbon stops, only the difference in tension of the rubber belt 3 is applied to the driving roller mechanism 5. Therefore, the driving roller mechanism 5 is urged to rotate opposite to the normal rotating direction.

Figure 2:
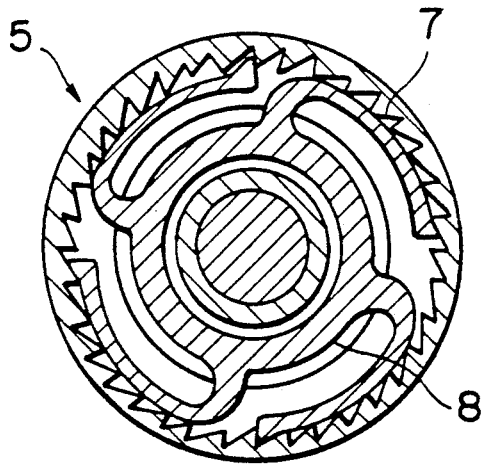
FIG. 2 is an enlarged sectional view showing a detail of the driving roller mechanism in the film ribbon cassette shown in FIG. 1.

FIG. 2 shows an enlarged sectional view of a detail of the driving roller mechanism 5.

As shown in FIG. 2, an interior of the driving roller 5 is provided with a tooth portion 7 for preventing reverse rotation on the inner periphery of its outer casing and correspondingly a ratchet wheel having a ratchet portion 8 on the end portion thereof is fixed to a spindle portion, and thus the above opposite rotation of the driving roller mechanism 5 is prevented by engaging the ratchet portion 8 with the tooth portion 7.

Figure 3:
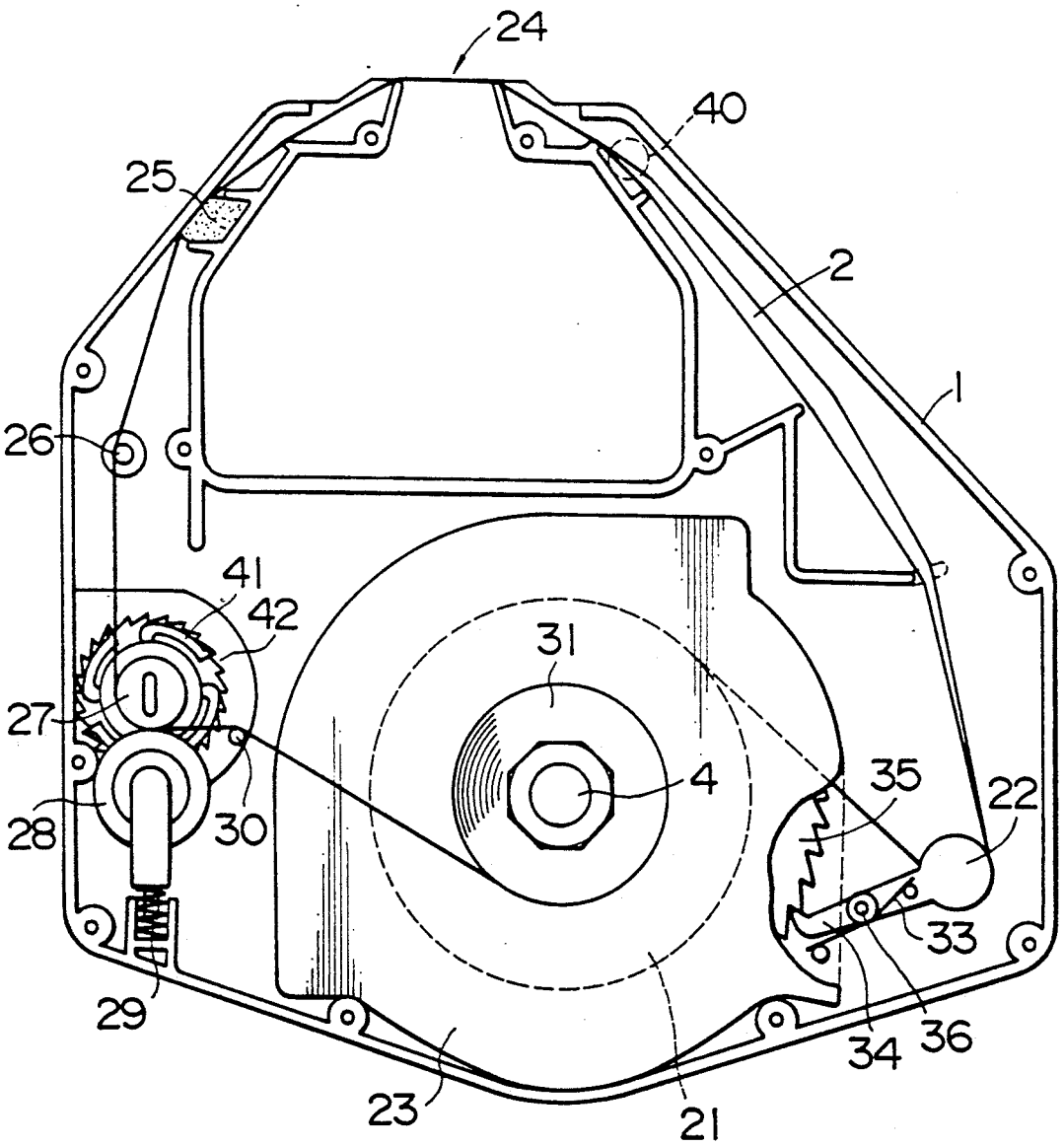
FIG. 3 is a plan view showing the film ribbon cassette, wherein the case has been opened so as to show the different elements constituting the cassette, according to the embodiment of this invention shown in FIG. 1.
Figure 4:
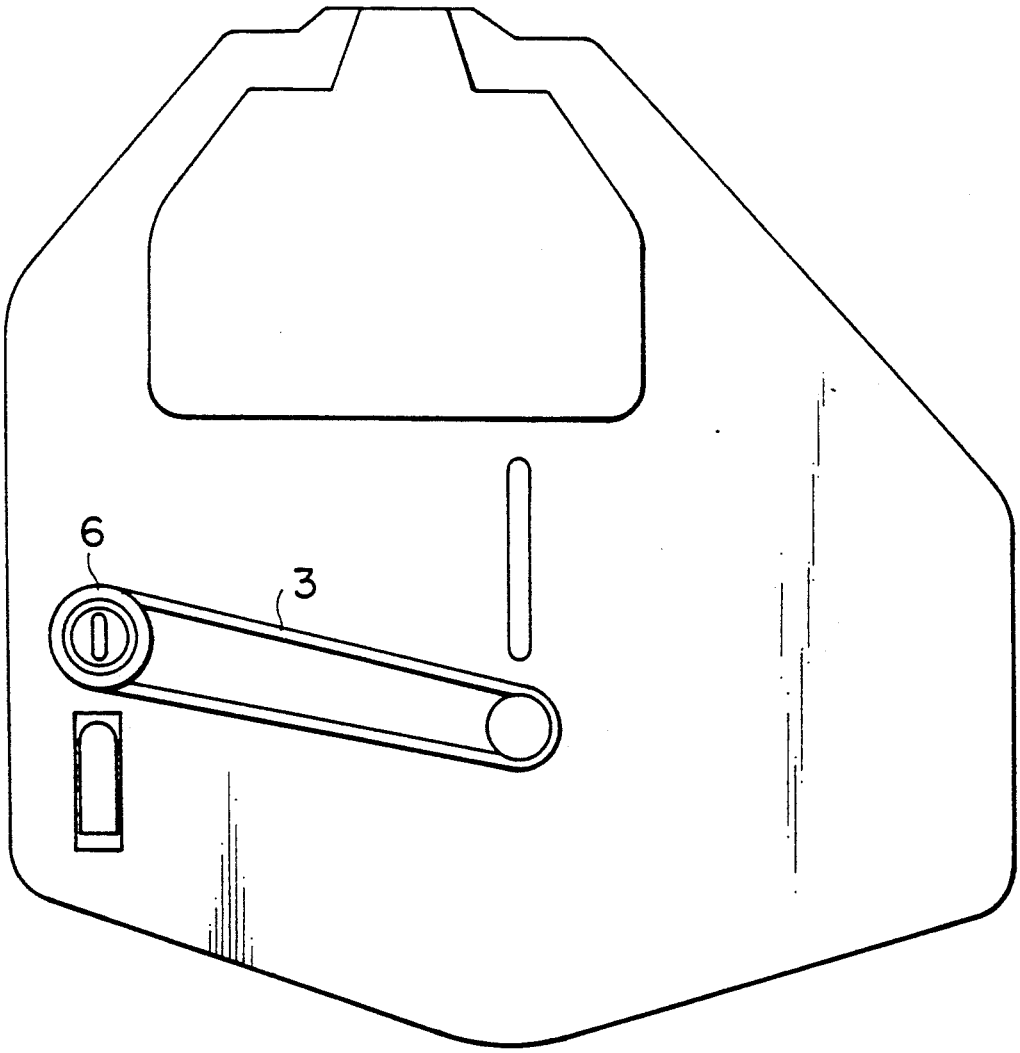
FIG. 4 is a plane view of the embodiment shown in FIG. 1.

As shown in FIGS. 3 and 4, a virgin film ribbon 2 is wound around a supply spool (not shown) to form a new ribbon roll 21. The film ribbon 2 passes from the roll 21 through a roller 22 for back tension to a printing window 24 and is used for printing therein. The used ink ribbon 2 passes through a sponge 25 for a stopper and a spindle 26 and then between a driving roller 27 and a rider roller 28 ridden on the driving roller 27 by a spring 29.

Thereafter, the film ribbon 2 passes around a spindle 30 and forms a used ribbon roll 31 on a take-up spool 4.

The new ribbon roll 21 and the used ribbon roll 31 are stacked with a separate plate interposed therebetween and are coaxial.

Driving means (not shown) of the film ribbon provided on a printing device rotate the driving roller 27 in a counterclockwise direction. The rotating power is also transmitted from the driving pulley 6 through the rubber belt 3 to the take-up spool 4 and rotates the used ribbon roll 31 in the same counterclockwise direction (see FIG. 4).

Tension in the film ribbon 2 occurred by the driving roller 27 and the rider roller 28 is used in order to take out the film ribbon 2 from the new ribbon roll 21. Under the state of the weaker tension, however, a toothed wheel 35 which rotates in harmony with the new ribbon roll 21 is locked by a ratchet portion 34 provided on the roller 22 for back tension and thus travel of the film ribbon 2 is not made. However, in the case that the tension became strong to some degree, driving power of the roller 22 for back tension is beyond the power of a spring 33 and thus the roller 22 is counterclockwise rotated centering around a spindle 36. As a result, the ratchet portion 34 leaves the toothed wheel 35 and the new ribbon roll 21 is rotated, whereby the delivery of the film ribbon is started.

Due the above mechanism, the tension in the film ribbon 2 can be maintained constant or to an enough value to take out the ribbon from the new ribbon roll 21.

The sponge 25 may be positioned at a location 40.

The driving roller 27 is provided with a ratchet portion 41 which is outside engaged with a tooth portion 42 for preventing reverse rotation, which is fixed to a case 1, whereby the driving roller is adapted not so as to rotate in a reverse direction or in a clockwise direction. Thus, the driving roller 27 is not reversely rotated even by the tension of the rubber belt 3 and as a result slackening does not occur in the film ribbon 2 and the film ribbon 2 is not reversely rotated.

What is claimed is:

1. A film ribbon cassette of a serial printer which comprises:

a driving roller being driven by traverse operation of a carriage of the serial printer, a driving pulley directly connected to an end portion of said driving roller, a rubber belt for transmitting the rotating motion of said driving pulley;

a winding pulley for winding the film ribbon which is driven by said rubber belt, an outer casing of said driving roller being provided with a tooth portion for preventing reverse rotation on an inner periphery thereof, a spindle portion of said driving roller being provided with a ratchet wheel having a ratchet portion which is engaged with said tooth portion, a rider roller which rides on the driving roller by spring means, a toothed wheel rotating in harmony with a new ribbon roll on which a virgin film ribbon is wound, and a roll for back tension provided with a ratchet portion which is engaged with the toothed wheel.

* * * * *